US008502514B2

(12) United States Patent
Hsu et al.

(10) Patent No.: US 8,502,514 B2
(45) Date of Patent: Aug. 6, 2013

(54) VOLTAGE REGULATION CIRCUIT

(75) Inventors: Shih-Hsien Hsu, Tainan County (TW); Yaw-Guang Chang, Tainan County (TW)

(73) Assignee: Himax Technologies Limited, Tainan (TW)

( * ) Notice: Subject to any disclaimer, the term of this patent is extended or adjusted under 35 U.S.C. 154(b) by 370 days.

(21) Appl. No.: 12/879,325

(22) Filed: Sep. 10, 2010

(65) Prior Publication Data

US 2012/0062193 A1 Mar. 15, 2012

(51) Int. Cl.
*G05F 1/40* (2006.01)

(52) U.S. Cl.
USPC ..... 323/282

(58) Field of Classification Search
USPC ..... 323/268, 271, 282, 285
See application file for complete search history.

(56) References Cited

U.S. PATENT DOCUMENTS

| | | | | |
|---|---|---|---|---|
| 5,512,814 | A | 4/1996 | Allman | |
| 5,867,015 | A | 2/1999 | Corsi et al. | |
| 6,188,211 | B1 * | 2/2001 | Rincon-Mora et al. | 323/280 |
| 6,822,428 | B2 * | 11/2004 | Miyanaga et al. | 323/284 |
| 7,173,482 | B2 | 2/2007 | Lobb et al. | |
| 7,268,524 | B2 * | 9/2007 | Kase et al. | 323/282 |
| 7,298,567 | B2 | 11/2007 | Poss | |
| 7,576,531 | B2 * | 8/2009 | Nakabayashi | 323/285 |
| 7,880,452 | B1 * | 2/2011 | Prasad et al. | 323/282 |

FOREIGN PATENT DOCUMENTS

| | | |
|---|---|---|
| TW | 200609701 | 3/2006 |
| TW | 200640125 | 11/2006 |
| TW | 200910043 | 3/2009 |

OTHER PUBLICATIONS

"Office Action of Taiwan Counterpart Application", issued on Apr. 29, 2013, p1-p8, in which the listed references were cited.

* cited by examiner

*Primary Examiner* — Matthew Nguyen
(74) *Attorney, Agent, or Firm* — J.C. Patents

(57) ABSTRACT

A voltage regulation circuit including a differential input unit, a source follower and a driving unit is provided. The differential input unit has a first input terminal and a second input terminal for receiving a reference voltage and a system voltage respectively. Further, the differential input unit compares the reference voltage and the system voltage and accordingly generates a control voltage. The source follower is electrically connected between the differential input unit and the driving unit, and generates an adjustment voltage according to the control voltage. The differential input unit, the source follower and the driving unit form a feedback loop, so that the driving unit fixes a source voltage to the system voltage according to the adjustment voltage.

13 Claims, 4 Drawing Sheets

VOLTAGE REGULATION CIRCUIT

BACKGROUND OF THE INVENTION

1. Field of the Invention

The invention relates generally to a voltage regulation circuit, and more particularly, to a voltage regulation circuit having a source follower.

2. Description of Related Art

A power supply is an important component of a portable device such as a mobile phone. Generally speaking, a source voltage of the portable device is typically provided by a battery. Moreover, to limit power consumption and enhance system stability with regards to an internal digital circuit, the portable device typically employs a voltage regulation circuit to perform voltage level adjustments of the source voltage provided by the battery, thereby fixing an operational voltage of the digital circuit to a predetermined value.

The voltage regulation circuit fixes the source voltage outputted by the power supply to a predetermined voltage value and thereafter provides the regulated voltage for the internal circuitry. A conventional voltage regulation circuit has an external stabilizing capacitor to prevent an overly large instantaneous response current in the digital circuit, and moreover to meet a stability requirement. However, the external stabilizing capacitor usually increases a physical size and a production cost of the system.

Therefore, in order to reduce the physical size and the production cost, how to implement a voltage regulator without requiring an external stabilizing capacitor has become an imperative issue for the design of the power supply in the portable device.

SUMMARY OF THE INVENTION

An aspect of the invention provides a voltage regulation circuit using a source follower to provide a faster stabilizing speed, thereby lowering a variation of a system voltage.

An aspect of the invention provides a voltage regulation circuit capable of suppressing an instantaneous current without adding a stabilizing capacitor.

An aspect of the invention provides a voltage regulation circuit including a differential input unit, a source follower, and a driving unit. The differential input unit has a first input terminal and a second input terminal for receiving a reference voltage and a system voltage respectively. Moreover, the differential input unit compares the reference voltage and the system voltage and accordingly generates a control voltage. The source follower is electrically connected to the differential input unit, and the source follower generates an adjustment voltage according to the control voltage. The driving unit is electrically connected to the source follower and the second terminal of the differential input unit, so as to form a feedback loop. Moreover, the driving unit fixes the source voltage to the system voltage according to the adjustment voltage.

According to an embodiment of the invention, the differential input unit and the source follower operate under a preset voltage, and the preset voltage is larger or equal to the source voltage.

According to an embodiment of the invention, the voltage regulation circuit further includes a voltage converter. The voltage converter is electrically connected to the differential input unit and the source follower, and the voltage converter converts the source voltage into a preset voltage. The differential input unit and the source follower operate under the preset voltage.

Another aspect of the invention provides a voltage regulation circuit including a differential input unit, a source follower, and a driving unit, and a feedback unit. The differential input unit has a first input terminal and a second input terminal for receiving a reference voltage and a feedback voltage respectively. Moreover, the differential input unit compares the reference voltage and the feedback voltage and accordingly generates a control voltage. The source follower is electrically connected to the differential input unit, and the source follower generates an adjustment voltage according to the control voltage. The driving unit is electrically connected to the source follower, and the driving unit fixes a source voltage to a system voltage according to the adjustment voltage. The feedback unit is electrically connected to the driving unit and the second input terminal of the differential input unit, so as to form a feedback loop. Furthermore, the feedback unit generates the feedback voltage according to the system voltage.

In summary, embodiments of the invention configure a source follower between a differential input unit and a driving unit. Therefore, when a large instantaneous current is generated, the source follower provides a faster stabilizing speed, thereby lowering a variation of the system voltage. Moreover, without adding an external stabilizing capacitor, the voltage regulation circuit according to embodiments of the invention can suppress the instantaneous current. In comparison to a conventional voltage regulation circuit, the voltage regulation circuit according to embodiments of the invention may reduce a physical size and a production cost of a portable device.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
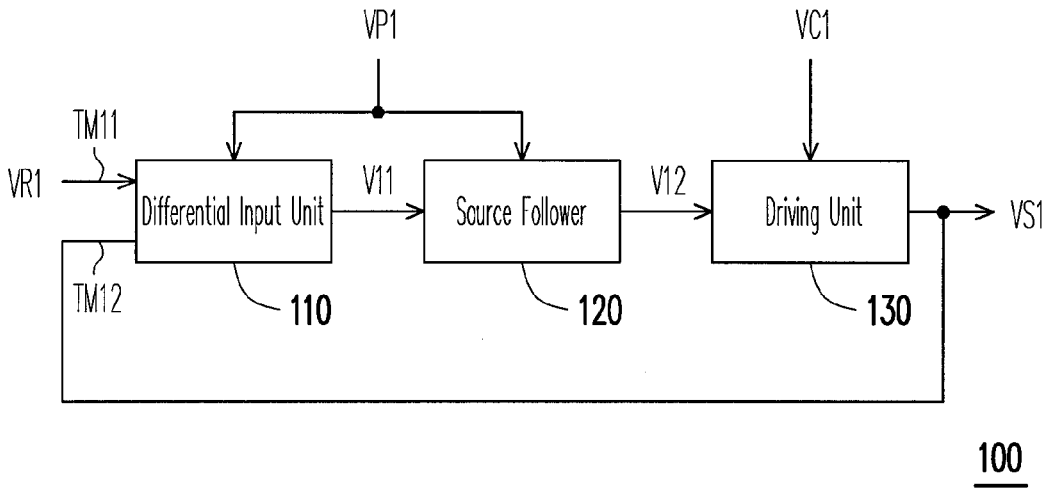
FIG. 1A is a schematic block diagram of a voltage regulation circuit according to an embodiment of the invention.

FIG. 1A is a schematic block diagram of a voltage regulation circuit according to an embodiment of the invention. Referring to FIG. 1A, a voltage regulation circuit 100 fixes a source voltage VC1 to a system voltage VS1. Accordingly, when the voltage regulation circuit 100 is applied in a portable device such as a mobile phone, the source voltage VC1 provided by a battery can be converted by the voltage regulation circuit 100 into the system voltage VS1 required by a digital circuit, thereby enhancing a system stability of the portable device.

The voltage regulation circuit 100 includes a differential input unit 110, a source follower 120, and a driving unit 130. The differential input unit 110 and the source follower 120 are operating under a preset voltage VP1. Moreover, the differential input unit 110 has a first input terminal TM11 and a second input terminal TM12 for receiving a reference voltage VR1 and a system voltage VS1 respectively. In practice, the differential input unit 110 compares the reference voltage VR1 and the system VS1 and accordingly generates a control voltage V11. In addition, the source follower 120 is electrically connected to the differential input unit 110. Furthermore, the source follower 120 generates an adjustment voltage V12 according to the control voltage V11.

In another perspective, the driving unit 130 is electrically connected to the source follower 120 and the second terminal TM12 of the differential input unit 110. Accordingly, the differential input unit 110, the source follower 120, and the driving unit 130 form a feedback loop. Using the feedback loop, the driving unit 130 fixes the source voltage VC1 to the system voltage VS1 according to the adjustment voltage V12. Moreover, when a load (not drawn) being driven by the voltage regulation circuit 100 has a large instantaneous current generated, the source follower 120 provides a faster stabilizing speed, thereby lowering a variation of the system voltage VS1. In other words, without adding a stabilizing capacitor, the voltage regulation circuit 100 can suppress the instantaneous current. Accordingly, the voltage regulation circuit 100 may reduce the physical size and the production cost of the portable device.

Figure 1B:
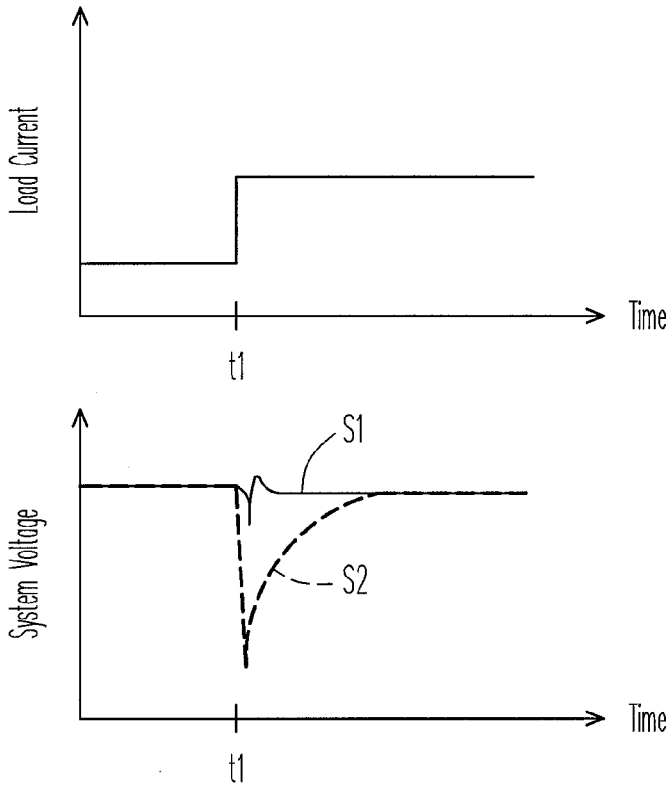
FIG. 1B is a curve diagram of a system voltage in the presence of an instantaneous current.

For an illustrative example, FIG. 1B is a curve diagram of a system voltage in the presence of an instantaneous current. An upper half of FIG. 1B is a curve diagram depicting a load current varying with time, and a lower half of FIG. 1B is a curve diagram depicting the system voltage varying with time. The curves S1 and S2 are system voltages generated by a conventional voltage regulation circuit and the voltage regulation circuit 100.

As shown in FIG. 1B, a large current variation of the load current is generated at a time reference t1. For the conventional voltage regulation circuit at this time, an external stabilizing capacitor thereof can be used to suppress the instantaneous current. However, as shown by the curve S2, once the stabilizing capacitor is removed, the system voltage produced by the conventional voltage regulation circuit experiences a drastic change, thereby resulting in an unstable output for the circuit. By contrast, for the voltage regulation circuit 100 depicted in FIG. 1, when the instantaneous current is generated, the source follower 120 provides a faster stabilizing speed, as shown by the curve S1. Therefore, the influence of the instantaneous current on the system voltage is suppressed.

Figure 2:
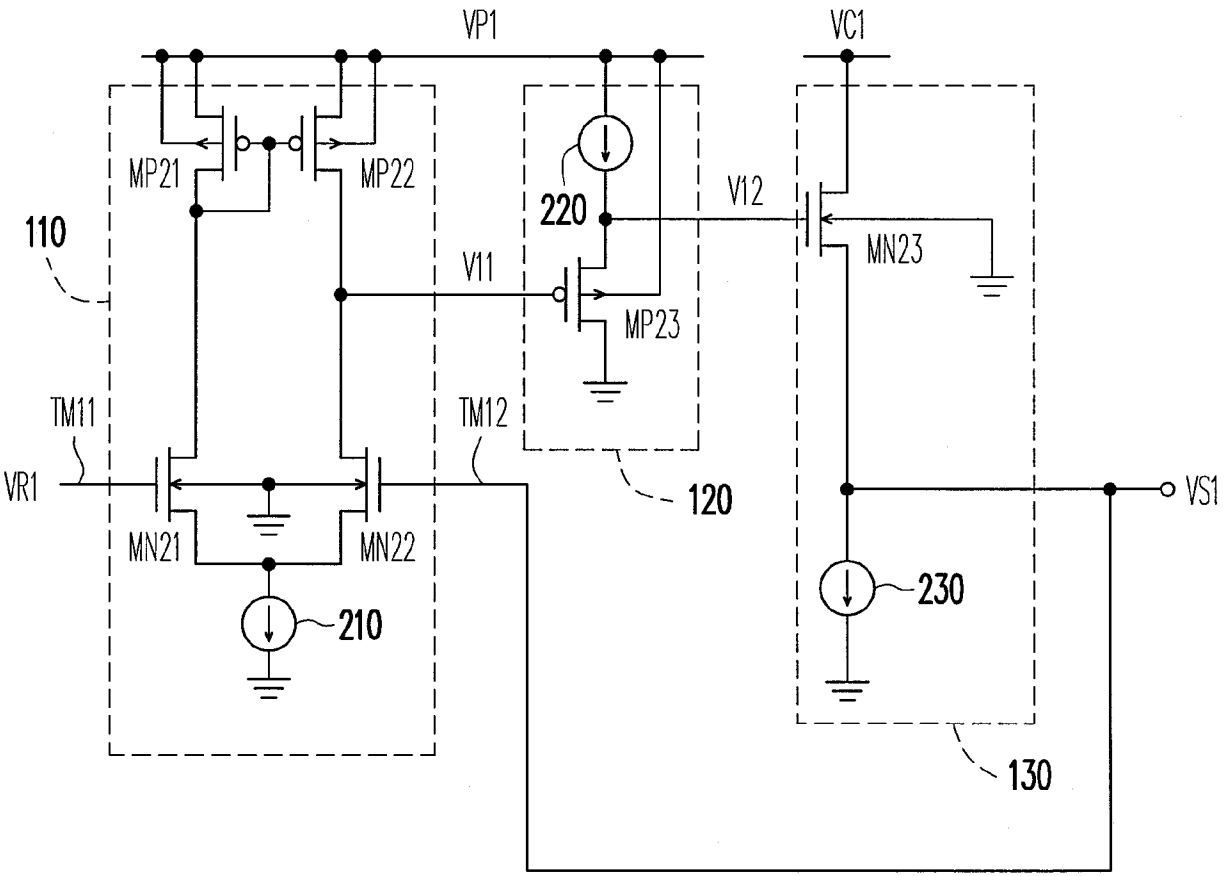
FIG. 2 is a circuit diagram of a voltage regulation circuit according to an embodiment of the invention

To make the invention more comprehensible to persons having ordinary knowledge in the art, FIG. 2 is a circuit diagram of a voltage regulation circuit according to an embodiment of the invention. The detailed structures of the differential input unit 110, the source follower 120, and the driving unit 130 are shown in FIG. 2.

Referring to FIG. 2, the differential input unit 110 includes P-type transistors MP21 and MP22, N-type transistors MN21 and MN22, and a current source 210. The P-type transistors MP21 and MP22 have sources used for receiving the preset voltage VP1, so that the differential input unit 110 operates under the preset voltage VP1. Moreover, the P-type transistor MP21 has a drain and a gate electrically connected to each other, and the gates of the P-type transistors MP21 and MP22 are electrically connected to each other. Accordingly, the P-type transistors MP21 and MP22 form a current mirror, and the P-type transistor MP22 has a drain used for generating the control voltage V11.

Moreover, the N-type transistors MN21 and MN22 have drains electrically connected to the drains of the P-type transistors MP21 and MP22, and the gates of the N-type transistors MN21 and MN22 are for receiving the reference voltage VR1 and the system voltage VS1 respectively. In addition, the current source 210 has a first terminal electrically connected to the sources of the N-type transistors MN21 and MN22, and a second terminal electrically connected to a ground terminal. Accordingly, the differential input unit 110 is substantially a single-stage operational amplifier capable of comparing the reference voltage VR1 and the system VS1 and accordingly generating the control voltage V11.

Continuing reference to FIG. 2, the source follower 120 includes a current source 220 and a P-type transistor MP23. The current source 220 has a first terminal receiving the preset voltage VP1, so that the source follower 120 operates under the preset voltage VP1. The current source 220 has a second terminal used for generating the adjustment voltage V12. The P-type transistor MP23 has a source electrically connected to the second terminal of the current source 220, a gate receiving the control voltage V11, and a drain electrically connected to the ground terminal. Therefore, the source follower 120 can detect the level of the control voltage V11 and accordingly generate the adjustment voltage V12.

The driving unit 130 includes a N-type transistor NM23 and a current source 230. The N-type transistor NM23 has a drain receiving the source voltage VC1, a gate receiving the adjustment voltage V12, and a source used for generating the system voltage VS1. In addition, the current source 230 has a first terminal electrically connected to the source of the N-type transistor NM23, and a second terminal electrically connected to the ground terminal. With the feedback loop formed by the differential input unit 110, the source follower 120, and the driving unit 130, the control voltage V11 and the adjustment voltage V12 generates corresponding changes along with the system voltage VS1. On the other hand, with the N-type transistor NM23 under the control of the adjustment voltage V12, the source voltage VC1 can be fixed to the system voltage VS1, and the system voltage VS1 is equal to the reference voltage VR1.

It should be noted that, in each of the embodiments described above, the preset voltage VP1 is larger or equal to the source voltage VC1. Moreover, when the preset voltage VP1 is equal to the source voltage VC1, the differential input unit 110 and the source follower 120 may operate directly under the source voltage VC1. In another perspective, when the preset voltage VP1 is larger than the source voltage VC1, the voltage regulation circuit 100 further includes a voltage converter for generating the preset voltage VP1 needed by the differential input unit 110 and the source follower 120.

Figure 3:
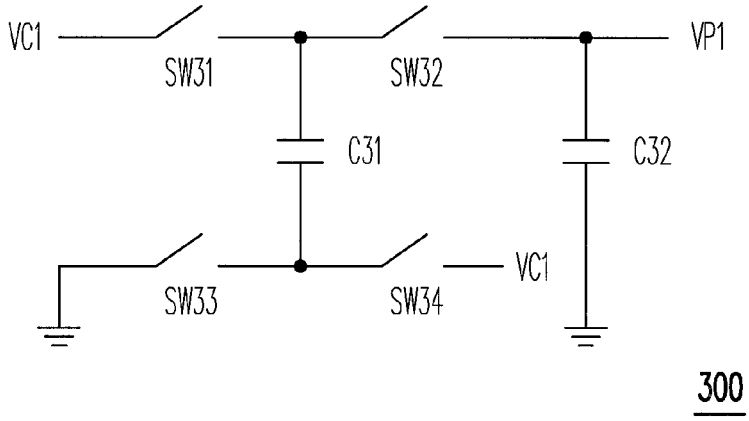
FIG. 3 is a circuit diagram of a voltage converter according to an embodiment of the invention

For example, FIG. 3 is a circuit diagram of a voltage converter according to an embodiment of the invention. Referring to FIG. 3, a voltage converter 300 is used for converting the source voltage VC1 into the preset voltage VP1. Moreover, the voltage converter 300 is electrically connected to the differential input unit 110 and the source follower 120, for providing the preset voltage VP1 to the differential input unit 110 and the source follower 120. Furthermore, the voltage converter 300 includes a plurality of switches SW31-SW34, a capacitor 31, and a capacitor 32. The switch 31 has a first terminal receiving the source voltage VC1, and a second terminal electrically connected to a first terminal of the switch 32 and a first terminal of the capacitor 31. The switch SW32 has a second terminal used for generating the preset voltage VP1. The capacitor C31 has a second terminal electrically connected to the first terminals of the switches SW33 and SW34. The switch SW33 has a second terminal electrically connected to the ground terminal, and the switch SW34 has a second terminal receiving the source terminal VC1. The capacitor C32 has a first terminal electrically connected to the second terminal of the switch SW32, and a second terminal electrically connected to the ground terminal.

In practice, when beginning operation the switches SW31 and SW33 are turned on, so that the capacitor C31 is charged to the source voltage VC1. Thereafter, the switches SW32 and SW34 are turned on, so that the capacitors C31 and C32 are serially connected, and the capacitor C32 is charged to two times the source voltage VC1. In other words, by a switching of the switches SW31-SW34, a current flowing through the capacitors C31 and C32 would generate a corresponding change, thereby causing the preset voltage VP1 generated by the voltage converter 300 to be two times the source voltage VC1.

Figure 4:
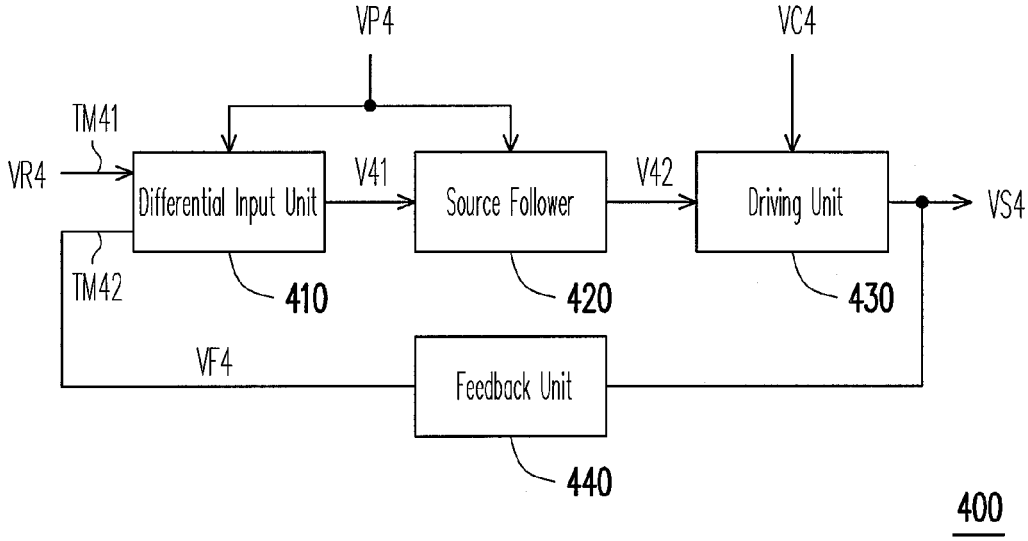
FIG. 4 is a schematic block diagram of a voltage regulation circuit according to another embodiment of the invention.

FIG. 4 is a schematic block diagram of a voltage regulation circuit according to another embodiment of the invention. Referring to FIG. 4, a voltage regulation circuit 400 is used for fixing a source voltage VC4 to a system voltage VS4, and includes a differential input unit 410, a source follower 420, a driving unit 430, and a feedback unit 440. Moreover, the differential input unit 410 has a first input terminal TM41 and a second input terminal TM42 for receiving a reference voltage VR4 and a feedback voltage VF4 respectively. Furthermore, the second input terminal TM42 of the differential input unit 410 is electrically connected to the feedback unit 440. The source follower 420 is electrically connected to the differential input unit 410. The driving unit 430 is electrically connected to the source follower 420 and the feedback unit 440.

The differential input unit 410 and the source follower 420 are operating under a predetermined voltage VP4. Additionally, in practice, the differential input unit 410 compares the reference voltage VR4 and the system VS4 and accordingly generates a control voltage V41. Furthermore, the source follower 420 generates an adjustment voltage V42 according to the control voltage V41. In another perspective, the driving unit 430 converts the source voltage VC4 to the system voltage VS4 according to the adjustment voltage VS42, and transmits the system voltage VS4 to the feedback unit 440. At this time, the feedback unit 440 generates the feedback voltage VF4 according to the system voltage VS4, and feeds back the feedback voltage VF4 to the differential input unit 410.

Accordingly, the differential input unit 410, the source follower 420, the driving unit 430, and the feedback unit 440 form a feedback loop. Using the feedback loop, the driving unit 430 fixes the source voltage VC4 to the system voltage VS4. It should be noted that, when a load (not drawn) being driven by the voltage regulation circuit 400 has a large instantaneous current generated, the source follower 420 provides a faster stabilizing speed, thereby lowering a variation of the system voltage VS4. In other words, without adding a stabilizing capacitor, the voltage regulation circuit 400 can suppress the instantaneous current. Accordingly, the voltage regulation circuit 400 may reduce the physical size and the production cost of the portable device.

Figure 5:
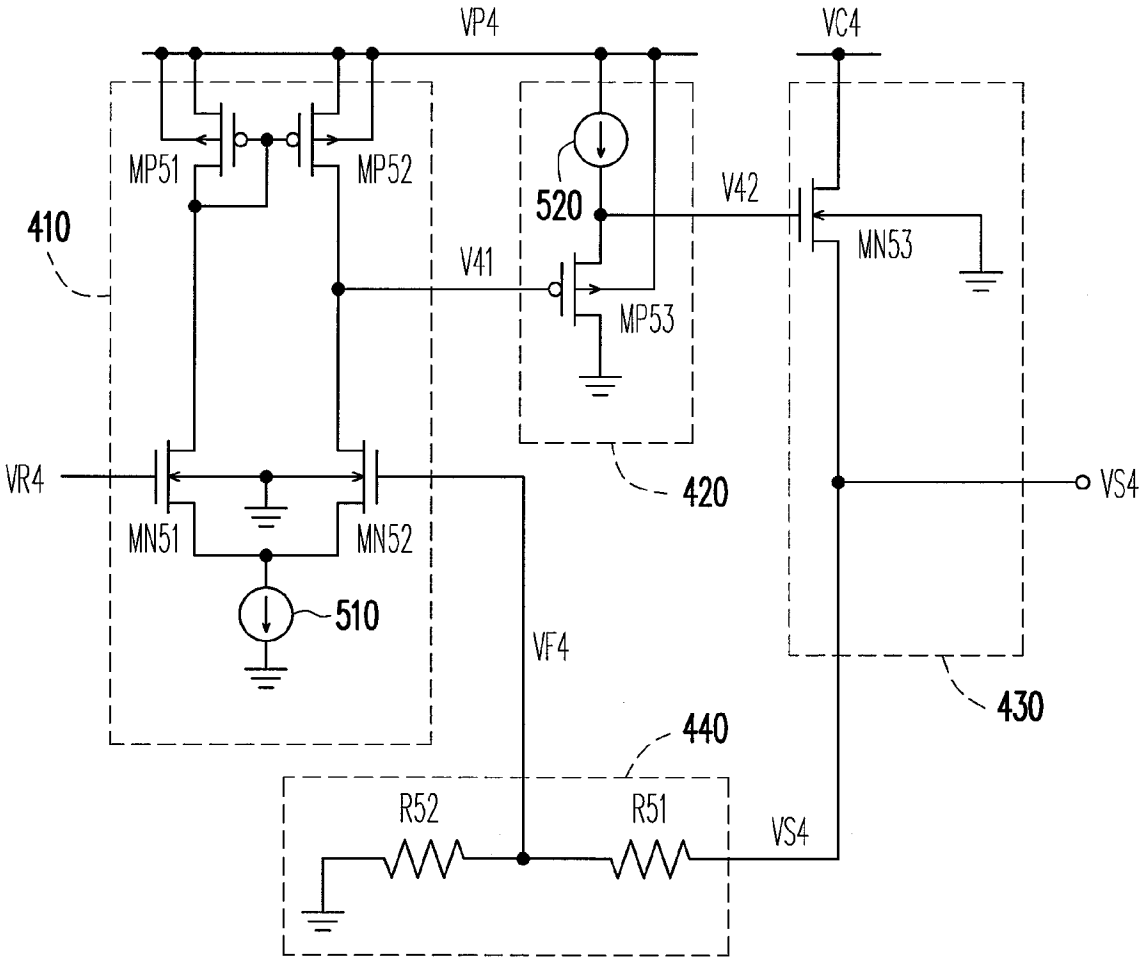
FIG. 5 is a circuit diagram of a voltage regulation circuit according to another embodiment of the invention.

To make the invention more comprehensible to persons having ordinary knowledge in the art, FIG. 5 is a circuit diagram of a voltage regulation circuit according to another embodiment of the invention. The detailed structures of the differential input unit 410, the source follower 420, the driving unit 430, and the feedback unit 440 are shown in FIG. 5.

Referring to FIG. 5, the differential input unit 410 includes P-type transistors MP51 and MP52, N-type transistors MN51 and MN52, and a current source 510. The P-type transistors MP51 and MP52 have sources used for receiving the preset voltage VP4, so that the differential input unit 410 operates under the preset voltage VP4. Moreover, the P-type transistor MP51 has a drain and a gate electrically connected to each other, and the gates of the P-type transistors MP51 and MP52 are electrically connected to each other. Accordingly, the P-type transistors MP51 and MP52 form a current mirror, and the P-type transistor MP52 has a drain used for generating the control voltage V41.

Moreover, the N-type transistors MN51 and MN52 have drains electrically connected to the drains of the P-type transistors MP51 and MP52, and the gates of the N-type transistors MN51 and MN52 are for receiving the reference voltage VR4 and the feedback voltage VF4. Additionally, the N-type transistors MN51 and MN52 are electrically connected to the ground terminal through the source terminal 510. Accordingly, the differential input unit 410 is substantially a single-stage operational amplifier capable of comparing the reference voltage VR4 and the feedback voltage VF4 and accordingly generating the control voltage V41.

Continuing reference to FIG. 5, the source follower 420 includes a current source 520 and a P-type transistor MP53. Moreover, the current source 520 has a first terminal receiving the preset voltage VP4, and a second terminal electrically connected to the source of the P-type terminal MP53. Moreover, the P-type transistor MP53 has a gate receiving the control voltage V41, and a drain electrically connected to the ground terminal. Therefore, the source follower 420 can detect the level of the control voltage V41 and accordingly generate the adjustment voltage V42.

In another perspective, the driving unit 430 includes a N-type transistor NM53, and the feedback unit 440 includes a resistor R51 and a resistor R52. The N-type transistor NM23 has a drain receiving the source voltage VC4, a gate receiving the adjustment voltage V42, and a source used for generating the system voltage VS4. Moreover, the resistor R51 has a first terminal receiving the system voltage VS4, and a second terminal used for generating the feedback voltage VF4. The resistor R52 has a first terminal electrically connected to the second terminal of the resistor R51, and a second terminal electrically connected to the ground terminal. In practice, the N-type transistor NM53 adjusts a current thereof according to the adjustment voltage V42, thereby fixing the source voltage VC4 to the system voltage VS4. The system voltage VS4 may be represented by the following equation: VS4=VR4*(R51+R52)/R52. Moreover, the system voltage VS4 transmitted to the feedback unit 440 generates a voltage division through the resistors R51 and R52, thereby forming the feedback voltage VF4.

It should be noted that, in each of the embodiments described above, the preset voltage VP4 is larger or equal to the source voltage VC4. Moreover, when the preset voltage VP4 is equal to the source voltage VC4, the differential input unit 410 and the source follower 420 may operate directly under the source voltage VC4. In another perspective, when the preset voltage VP4 is larger than the source voltage VC4, the voltage regulation circuit 400 further includes a voltage converter for generating the preset voltage VP4 needed by the differential input unit 410 and the source follower 420. The voltage converter may be the voltage converter 300 depicted in FIG. 3, for example, although the invention should not be construed as limited thereto.

In view of the foregoing, embodiments of the invention configure a source follower between a differential input unit and a driving unit. Therefore, when a large instantaneous current is generated, the source follower provides a faster stabilizing speed, thereby lowering a variation of the system voltage. Moreover, without adding an external stabilizing capacitor, the voltage regulation circuit according to embodiments of the invention can suppress the instantaneous current, thereby reducing the physical size the production cost of the portable device.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A voltage regulation circuit, comprising:

a differential input unit having a first input terminal and a second input terminal for receiving a reference voltage and a system voltage respectively, and the differential input unit comparing the reference voltage and the system voltage and accordingly generating a control voltage;

a source follower electrically connected to the differential input unit for receiving the control voltage and generating an adjustment voltage; and a driving unit electrically connected to the source follower and the second input terminal of the differential input unit, so as to form a feedback loop, and the driving unit fixing a source voltage to the system voltage according to the adjustment voltage, wherein the driving unit is electrically connected to the source voltage, the differential input unit and the source follower operate under a preset voltage, the preset voltage and the source voltage are two independent voltages, and a voltage value of the preset voltage is larger or equal to a voltage value of the source voltage.

2. The voltage regulation circuit as claimed in claim 1, wherein the differential input unit comprises:a first P-type transistor having a source receiving the preset voltage, a drain and a gate, wherein the drain and the gate of the first P-type transistor are electrically connected to each other;

a second P-type transistor having a source receiving the preset voltage, a gate electrically connected to the gate of the first P-type transistor, and a drain generating the control voltage;

a first N-type transistor having a drain electrically connected to the drain of the first P-type transistor, and a gate receiving the reference voltage;

a second N-type transistor having a drain electrically connected to the drain of the second P-type transistor, and a gate receiving the system voltage; and a first current source having a first terminal electrically connected to the sources of first N-type transistor and the second N-type transistor, and a second terminal electrically connected to a ground terminal.

3. The voltage regulation circuit as claimed in claim 1, wherein the source follower comprises:

a second current source having a first terminal receiving the preset voltage, and a second terminal generating the adjustment voltage; and a third P-type transistor having a source electrically connected to the second terminal of the second current source, a gate receiving the control voltage, and a drain electrically connected to a ground terminal.

4. The voltage regulation circuit as claimed in claim 1, further comprising:

a voltage converter electrically connected to the differential input unit and the source follower, and the voltage converter converting the source voltage into a preset voltage, wherein the differential input unit and the source follower operate under the preset voltage.

5. The voltage regulation circuit as claimed in claim 4, wherein the preset voltage is twice the source voltage, and the voltage converter comprises:

a first switch having a first terminal receiving the source voltage;

a second switch having a first terminal electrically connected to a second terminal of the first switch, and a second terminal used for generating the preset voltage;

a first capacitor having a first terminal electrically connected to the second terminal of the first switch;

a third switch having a first terminal electrically connected to a second terminal of the first capacitor, and a second terminal electrically connected to a ground terminal;

a fourth switch having a first terminal electrically connected to the second terminal of the first capacitor, and a second terminal receiving the source voltage; and a second capacitor having a first terminal electrically connected to the second terminal of the second switch, and a second terminal electrically connected to the ground terminal.

6. The voltage regulation circuit as claimed in claim 1, wherein the driving unit comprises:

a third N-type transistor having a drain receiving the source voltage, a gate receiving the adjustment voltage, and a source used for generating the system voltage; and a third current source having a first terminal electrically connected to the source of the third N-type transistor, and a second terminal electrically connected to a ground terminal.

7. A voltage regulation circuit, comprising:

a differential input unit having a first input terminal and a second input terminal for receiving a reference voltage and a feedback voltage respectively, and the differential input unit comparing the reference voltage and the feedback voltage and accordingly generating a control voltage;

a source follower electrically connected to the differential input unit for receiving the control voltage and generating an adjustment voltage;

a driving unit electrically connected to the source follower, and the driving unit fixing a source voltage to a system voltage according to the adjustment voltage; and a feedback unit electrically connected to the driving unit and the second input terminal of the differential input unit, so as to form a feedback loop, and the feedback unit generating the feedback voltage according to the system voltage, wherein the driving unit is electrically connected to the source voltage, the differential input unit and the source follower operate under a preset voltage, the preset voltage and the source voltage are two independent voltages, and a voltage value of the preset voltage is larger or equal to a voltage value of the source voltage.

8. The voltage regulation circuit as claimed in claim 7, wherein the differential input unit comprises:

a first P-type transistor having a source receiving the preset voltage, a drain and a gate, wherein the drain and the gate of the first P-type transistor are electrically connected to each other;

a second P-type transistor having a source receiving the preset voltage, a gate electrically connected to the gate of the first P-type transistor, and a drain generating the control voltage;

a first N-type transistor having a drain electrically connected to the drain of the first P-type transistor, and a gate receiving the reference voltage;

a second N-type transistor having a drain electrically connected to the drain of the second P-type transistor, and a gate receiving the feedback voltage; and a first current source having a first terminal electrically connected to the sources of first N-type transistor and the second N-type transistor, and a second terminal electrically connected to a ground terminal.

9. The voltage regulation circuit as claimed in claim 7, wherein the source follower comprises:

a second current source having a first terminal receiving the preset voltage, and a second terminal generating the adjustment voltage; and a third P-type transistor having a source electrically connected to the second terminal of the second current source, a gate receiving the control voltage, and a drain electrically connected to a ground terminal.

10. The voltage regulation circuit as claimed in claim 7, further comprising:

a voltage converter electrically connected to the differential input unit and the source follower, and the voltage converter converting the source voltage into a preset voltage, wherein the differential input unit and the source follower operate under the preset voltage.

11. The voltage regulation circuit as claimed in claim 10, wherein the preset voltage is twice the source voltage, the voltage converter comprises:

a first switch having a first terminal receiving the source voltage;

a second switch having a first terminal electrically connected to a second terminal of the first switch, and a second terminal used for generating the preset voltage;

a first capacitor having a first terminal electrically connected to the second terminal of the first switch;

a third switch having a first terminal electrically connected to a second terminal of the first capacitor, and a second terminal electrically connected to a ground terminal;

a fourth switch having a first terminal electrically connected to the second terminal of the first capacitor, and a second terminal receiving the source voltage; and a second capacitor having a first terminal electrically connected to the second terminal of the second switch, and a second terminal electrically connected to the ground terminal.

12. The voltage regulation circuit as claimed in claim 7, wherein the driving unit comprises a third N-type transistor having a drain receiving the source voltage, a gate receiving the adjustment voltage, and a source generating the system voltage.

13. The voltage regulation circuit as claimed in claim 7, wherein the feedback unit comprises:

a first resistor having a first terminal receiving the system voltage, and a second terminal generating the feedback voltage; and a resistor having a first terminal electrically connected to the second terminal of the first resistor, and a second terminal electrically connected to the ground terminal.

* * * * *